US007998887B2

(12) United States Patent
Horiguchi et al.

(10) Patent No.: US 7,998,887 B2
(45) Date of Patent: Aug. 16, 2011

(54) NONWOVEN FABRIC CONTAINING ULTRA-FINE FIBERS, LEATHER-LIKE SHEET, AND PRODUCTION METHODS THEREOF

(75) Inventors: Tomoyuki Horiguchi, Otsu (JP); Kyoko Yokoi, Inukami-gun (JP); Kentaro Kajiwara, Otsu (JP)

(73) Assignee: Toray Industries, Inc. (JP)

( * ) Notice: Subject to any disclaimer, the term of this patent is extended or adjusted under 35 U.S.C. 154(b) by 0 days.

(21) Appl. No.: 10/564,789

(22) PCT Filed: Jul. 7, 2004

(86) PCT No.: PCT/JP2004/009626

§ 371 (c)(1),
(2), (4) Date: Jan. 13, 2006

(87) PCT Pub. No.: WO2005/007960

PCT Pub. Date: Jan. 27, 2005

(65) Prior Publication Data

US 2006/0234587 A1 Oct. 19, 2006

(30) Foreign Application Priority Data

Jul. 18, 2003 (JP) ..... 2003-198962
Dec. 16, 2003 (JP) ..... 2003-417656

(51) Int. Cl.
*G11B 9/00* (2006.01)
*D04H 1/46* (2006.01)
*D04H 1/00* (2006.01)

(52) U.S. Cl. ..... 442/333; 428/327; 442/360; 442/363; 442/383; 442/384; 442/387; 442/402; 442/408; 28/103; 28/112; 264/171.2

(58) Field of Classification Search ..... 8/94.19 R; 28/104, 159, 162; 156/155, 181, 62.4, 62.6; 264/172.17, DIG. 75; 427/331; 428/15, 428/91, 151, 364, 156, 315.5, 370, 373, 395, 428/687, 903, 904; 429/254; 442/189, 269, 442/350, 351, 104, 168, 170, 268, 271, 304, 442/308, 319, 340, 341, 408, 411, 60, 63, 442/77
See application file for complete search history.

(56) References Cited

U.S. PATENT DOCUMENTS 3,716,614 A * 2/1973 Okamoto et al. ..... 264/49
(Continued)

FOREIGN PATENT DOCUMENTS

EP 1 054 096 A1 11/2000
(Continued)

OTHER PUBLICATIONS

Kamath et al., "Needle Punched Nonwovens", http://www.engr.utk.edu/mse/Textiles/Needle%20Punched%20Nonwovens.htm. Apr. 2004.*

*Primary Examiner* — David Sample
*Assistant Examiner* — Nicole Gugliotta
(74) *Attorney, Agent, or Firm* — DLA Piper LLP (US)

(57) ABSTRACT

To provide a nonwoven fabric containing ultra-fine fibers suitable as a leather-like sheet, and also a leather-like sheet with an excellent compactness. A nonwoven fabric containing ultra-fine fibers, characterized in that it contains staple fibers with a fiber fineness of 0.0001 to 0.5 decitex and a fiber length of 10 cm or less, and has a weight per unit area of 100 to 550 g/m$^2$, an apparent density of 0.280 to 0.700 g/cm$^3$, a tensile strength of 70 N/cm or more, and a tear strength of 3 to 50 N.

15 Claims, 1 Drawing Sheet

U.S. PATENT DOCUMENTS

Figure 1:
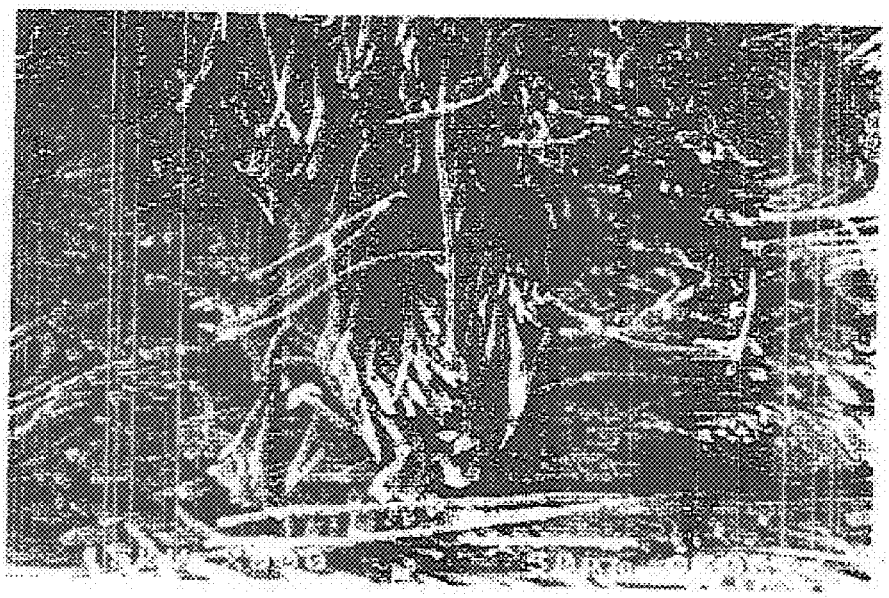
Figure 2:
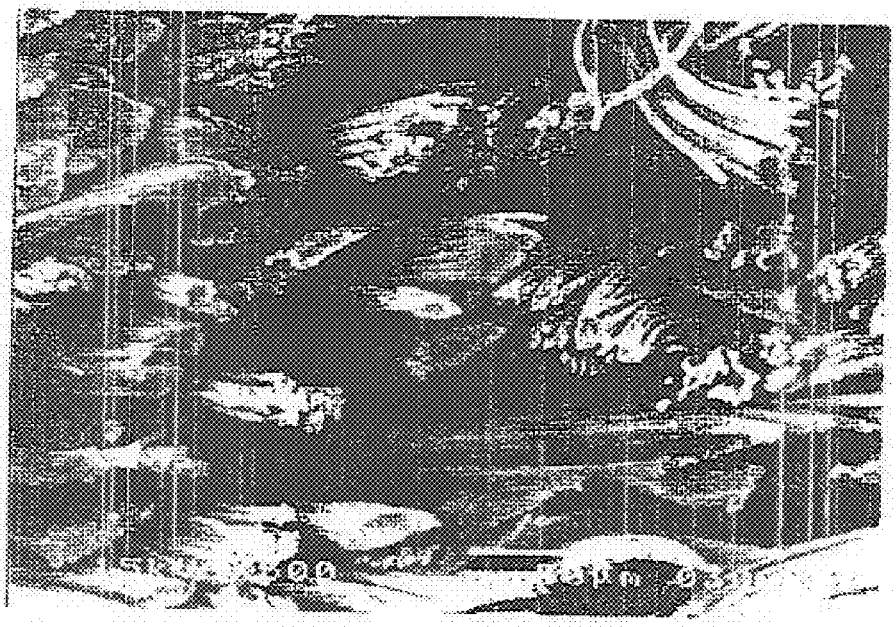

| | | | | | |
|---|---|---|---|---|---|
| 3,914,501 | A | * | 10/1975 | Miller et al. | 442/350 |
| 4,107,374 | A | * | 8/1978 | Kusunose et al. | 442/400 |
| 4,145,468 | A | * | 3/1979 | Mizoguchi et al. | 442/269 |
| 4,426,421 | A | * | 1/1984 | Nakamae et al. | 442/271 |
| 4,476,186 | A | * | 10/1984 | Kato et al. | 442/60 |
| 4,587,142 | A | * | 5/1986 | Higuchi et al. | 428/15 |
| 5,256,429 | A | * | 10/1993 | Honda et al. | 442/189 |
| 5,888,916 | A | * | 3/1999 | Tadokoro et al. | 442/334 |
| 6,117,489 | A | * | 9/2000 | Ohkawa et al. | 427/331 |
| 6,276,121 | B1 | | 8/2001 | Nabeshima et al. | |
| 6,537,660 | B2 | * | 3/2003 | Katayama et al. | 428/364 |
| 6,566,287 | B1 | * | 5/2003 | Mimura et al. | 442/351 |
| 6,706,843 | B1 | | 3/2004 | Ishihara et al. | |
| 2001/0027246 | A1 | | 10/2001 | Murayama et al. | |
| 2002/0013111 | A1 | | 1/2002 | Dugan et al. | |
| 2005/0118394 | A1 | * | 6/2005 | Tanaka et al. | 428/151 |
| 2005/0125907 | A1 | * | 6/2005 | Yamasaki et al. | 8/94.19 R |

FOREIGN PATENT DOCUMENTS

| | | | |
|---|---|---|---|
| JP | 52-12902 | A | 1/1977 |
| JP | 54-116417 | | 9/1979 |
| JP | 61-275483 | | 12/1986 |
| JP | 61-275483 | A | 12/1986 |
| JP | 63-042021 | | 2/1988 |
| JP | 01-018178 | B2 | 4/1989 |
| JP | 04-308271 | | 10/1992 |
| JP | 05-078986 | | 3/1993 |
| JP | 5-78986 | A | 3/1993 |
| JP | 05-171014 | | 7/1993 |
| JP | 5-171014 | A | 7/1993 |
| JP | 7-62301 | A | 3/1995 |
| JP | 7-62031 | B | 7/1995 |
| JP | 07-62301 | | 7/1995 |
| JP | 10/131058 | | 5/1998 |
| JP | 11-43835 | | 2/1999 |
| JP | 11-323740 | | 11/1999 |
| JP | 2000-336581 | | 12/2000 |
| JP | 2001-348457 | A | 12/2001 |
| JP | 2001-348457 | A | 12/2001 |
| JP | 2003-221791 | | 8/2003 |
| JP | 2003-286667 | | 10/2003 |
| WO | 99/23289 | A1 | 5/1999 |
| WO | WO 99/23289 | A1 | 5/1999 |
| WO | 01/30729 | A1 | 5/2001 |
| WO | WO 01/30729 | A1 | 5/2001 |

* cited by examiner

NONWOVEN FABRIC CONTAINING ULTRA-FINE FIBERS, LEATHER-LIKE SHEET, AND PRODUCTION METHODS THEREOF

CROSS REFERENCE TO RELATED APPLICATIONS

This application is a §71 of international Application No. PCT/JP2004/09626, with an international filing date of Jul. 7, 2004 (WO 2005/007960.A1, published Jan. 27, 2005), which claims priority from Japanese Application No. 2003-198962 filed Jul. 18, 2003, and from Japanese Application No. 2003-417656 filed Dec. 16, 2003.

TECHNICAL FIELD

This disclosure relates to a nonwoven fabric containing ultra-fine fibers particularly suitable as the base sheet of a leather-like sheet, and a production method thereof. In more detail, this disclosure relates to a nonwoven fabric containing ultra-fine fibers with excellent strength properties, which can be used as a leather-like sheet decreased in polyurethane content.

Furthermore, this disclosure relates to a leather-like sheet with an excellent compactness, which can be used, for example, for shoes, furniture, clothing, and also relates to a production method thereof. In more detail, this disclosure relates to a leather-like sheet made of mainly a fiber material and having sufficient hand and physical properties, and also a production method thereof.

BACKGROUND

Leather-like sheets consisting of ultra-fine fibers and an elastomer have excellent features unavailable in natural leather and are widely used in various applications. As a method generally employed for producing such a leather-like sheet, a fiber sheet is impregnated with an elastomer solution of a polyurethane or the like, and the impregnated fiber sheet is immersed in water or an organic solvent aqueous solution, to wet-coagulate the elastomer.

However, since the polyurethane must be used in a large amount for obtaining, for example, strength and size stability, the raw material cost of the polyurethane, complicated production process and the like make the leather-like sheet expensive. Furthermore, a higher elastomer content is likely to cause rubber-like hand, making it difficult to obtain a compactness similar to that of natural leather. Moreover, for the necessity of impregnation with the polyurethane, a water miscible organic solvent such as N,N'-dimethylformamide is generally used, though such organic solvents are not generally preferable in view of working environment.

Furthermore, in recent years, recyclability is respected for the purpose of protecting the environment, resources and the like, and in this connection, for example, polyester decomposing and recovering methods (for example, WO 01/30729) and polyurethane decomposing methods (for example, JP 2001-348457 A) are studied. However, these methods are mainly applied to a material consisting of a single component, and it is difficult to apply the methods to a composite material having fibers and an elastomer such as a polyurethane inseparably integrated as described above, since different decomposing methods are needed. So, separation into respective components is necessary, but in general the separation cost is high while perfect separation into respective components is also difficult.

Furthermore, it is reported that, for example, a polyurethane is yellowed by NOx gas or the like, and it is difficult to obtain a white suede-like sheet.

Therefore, a leather-like sheet containing less or substantially no elastomer such as a polyurethane is desired.

To solve these problems, it is an effective means to enhance the strength of the nonwoven fabric per se. Several means for enhancing the strength of the nonwoven fabric per se have been studied so far. For example, disclosed is a nonwoven fabric to be used as a leather-like sheet, consisting of fiber bundles and single fibers, obtained by using self-bonding fibers such as cellulose fibers for forming self-bonded bundles, treating them by such a means as needle punching to form a sheet, and jetting a high speed fluid flow to the sheet, to entangle the bundles with each other, to entangle the bundles with the single fibers and to entangle the single fibers with each other (for example, JP 52-12902 A). However, if bundles are bonded by such a method, there arise such problems that when the nonwoven fabric is dyed, color irregularity occurs and that the surface appearance and hand become poor. There is also a further other problem that since the high speed fluid flow causes the considerable portions of the self-bonded ultra-fine fibers to be debonded and entangled, irregular debonding occurs due to irregular treatment, making the control of debonding difficult.

On the other hand, proposed are various methods in which needle punching is followed by hydro-entanglement to improve entanglement (for example, JP 1-18178 B and JP 5-78986 A). These methods are respectively effective as a means for enhancing the entangling efficiency of hydro-entanglement. However, we the inventors found that even if needle punching and hydro-entanglement are merely combined, it is difficult to obtain a nonwoven fabric lowered in polyurethane content and still having satisfactory physical properties and quality maintained.

Furthermore, as a means different from the above-mentioned ones, it is disclosed that if polyester fibers with a low modulus and heat shrinkable polyester fibers are needle-punched, subsequently heat-treated and hot-pressed, a base sheet for a leather-like sheet having sufficient performance even without being impregnated with a polyurethane can be obtained (for example, JP 7-62301 B). However, we the inventors found that when the nonwoven fabric obtained like this was dyed, for example, using a jet dyeing machine, it was often broken by massaging and the like.

SUMMARY OF THE INVENTION

This invention provides particularly a nonwoven fabric containing ultra-fine fibers useful as a base sheet for a leather-like sheet and having a sufficient strength, and also a production method thereof. Furthermore, this invention provides a leather-like sheet having a sufficient quality, hand and physical properties and also excellent recyclability and yellowing resistance, even though it does not substantially contain any elastomer such as a polyurethane, and also provides a production method thereof.

This invention has the following constitution. The nonwoven fabric containing ultra-fine fibers of this invention contains staple fibers with a fiber fineness of 0.0001 to 0.5 decitex and a fiber length of 10 cm or less, and has a weight per unit area of 100 to 550 g/m$^2$, an apparent density of 0.280 to 0.700 g/cm$^3$, a tensile strength of 70 N/cm or more, and a tear strength of 3 to 50 N.

SUMMARY

We provide particularly a nonwoven fabric containing ultra-fine fibers useful as a base sheet for a leather-like sheet and having a sufficient strength, and also a production method thereof. Furthermore, we provide a leather-like sheet having a sufficient quality, hand and physical properties and also excellent recyclability and yellowing resistance, even though it does not substantially contain any elastomer such as a polyurethane, and also provides a production method thereof.

This disclosure has the following constitution. The nonwoven fabric containing ultra-fine fibers of this disclosure contains staple fibers with a fiber fineness of 0.0001 to 0.5 decitex and a fiber length of 1.0 cm or less, and has a weight per unit area of 100 to 550 g/m$^2$, an apparent density of 0.280 to 0.700 g/cm$^3$, a tensile strength of 70 N/cm or more, and a tear strength of 3 to 50 N.

Furthermore, the method for producing a nonwoven fabric containing ultra-fine fibers comprising the steps of needle-punching composite fibers with a fineness of 1 to 10 decitex convertible into bundles of ultra-fine fibers of 0.0001 to 0.5 decitex, to produce a nonwoven fabric containing composite fibers, and performing hydro-entanglement at a pressure of at least 10 MPa.

The leather-like sheet in one aspect comprises a nonwoven fabric and is substantially made of a fiber material of a non-elastic polymer.

And, the leather-like sheet in another aspect contains a dyed nonwoven fabric containing ultra-fine fibers with a fiber fineness of 0.0001 to 0:5 decitex, a fiber length of 10 cm or less, a weight per unit area of 100 to 550 g/m$^2$ and an apparent density of 0.230 to 0.700 g/cm$^3$, and has a tear strength of 3 to 50 N and satisfies the following formula:

$$\text{Tensile strength (N/cm)} \geqq 0.45 \times \text{Weight per unit area (g/m}^2\text{)} - 40$$

The method for producing a leather-like sheet in one aspect comprises the step of dyeing a nonwoven fabric containing ultra-fine fibers, which contains staple fibers with a fiber fineness of 0.0001 to 0.5 decitex and a fiber length of 10 cm or less, and has a weight per unit area of 100 to 550 g/m$^2$, an apparent density of 0.280 to 0.700 g/cm$^3$, a tensile strength of 70 N/cm or more and a tear strength of 3 to 50 N.

And, the method for producing a leather-like sheet in another aspect comprises the steps of needle-punching composite fibers convertible into bundles of ultra-fine fibers with a fineness of 0.0001to 0.5 decitex, for entangling them, subsequently converting the conjugate fibers into bundles of ultra-fine fibers, to form a nonwoven fabric containing ultra-fine fibers, then performing hydro-entanglement at a pressure of at least 10 MPa, for re-entangling, and subsequently dying.

We can provide a nonwoven fabric containing ultra-fine fibers with excellent strength properties, particularly suitable as a base sheet of a leather-like sheet. Furthermore, we can also provide a high quality leather-like sheet with the polyurethane content decreased greatly or without using any polyurethane at all.

Furthermore, we can provide a leather-like sheet with an excellent compactness, which can be used as shoes, furniture, clothing, etc.

DETAILED DESCRIPTION

The nonwoven fabric containing ultra-fine fibers contain fibers with a fiber fineness of 0.0001 to 0.5 decitex. A preferable fiber fineness range is from 0.001 to 0.3 decitex, and a more preferable range is from 0.005 to 0.15 decitex. It is not preferable that the fiber fineness is less than 0.0001 decitex, since the strength would declines. It is not preferable either that the fiber fineness is more than 0.5 decitex, since such problems would occur that the hand becomes hard, and that the entanglement is insufficient to make the surface appearance poor. Fibers with finenesses outside said range can also be contained to such an extent that the effects are not impaired.

The method for producing the so-called ultra-fine fibers with their fiber fineness kept in the aforesaid range is not especially limited. For example, available are methods in which ultra-fine fibers are directly produced by spinning, and methods in which composite fibers with an ordinary fineness convertible into bundles of ultra-fine fibers (composite fibers convertible into bundles of ultra-fine fibers) are produced by spinning and subsequently converted into ultra-fine fibers. The methods of using composite fibers convertible into bundles of ultra-fine fibers include, for example, methods in which islands-in-sea type conjugate fibers are produced by spinning, then the sea component being removed, and methods in which splittable fibers are produced by spinning and split into ultra-fine fibers. Among these methods, it is preferable to uses the islands-in-sea type conjugate, fibers or the splittable fibers for producing the ultra-fine fibers, since ultra-fine fibers can be obtained easily and stably. The method of using the islands-in-sea type conjugate fibers for producing the ultra-fine fibers is more preferable, since in the case where the use as a leather-like, sheet is intended, ultra-fine fibers made of one polymer capable of being dyed with one dye can be easily obtained.

The islands-in-sea type conjugate fibers mean the fibers, in each of which two or more components are conjugated and mixed at a given stage to realize a state where islands are dotted in the sea. The method for obtaining the fibers is not especially limited. For example, the following methods are available: (1) a method in which two or more polymers as components are blended as chips and spun; (2) a method in which chips obtained beforehand by kneading two or more polymers as components are spun; (3) a method in which two or more molten polymers as components are mixed by a stationary kneader or the like in the pack of a spinning machine; and (4) a method in which a die of JP44-18369B, JP54-116417A or the like is used for producing the fibers. Any of the methods can be used to allow good production. However, the method of (4) can be preferably used, since the polymers can be easily selected.

In the method of (4), the sectional form of each islands-in-sea type conjugate fiber and the sectional form of each island fiber obtained by removing the sea component are not especially limited. Examples-of the sectional form include circle, polygon, Y, H, X, W, C, π, etc. Furthermore, the number of polymers as components is not especially limited either, but considering the spinning stability and dyeability, two or three components are preferable. Especially it is preferable to use two components consisting of one sea component and one island component. Furthermore, in this case, with regard to the ratio of the components, it is preferable that the ratio by weight of the island fibers to the islands-in-sea type conjugate fiber is from 0.30 to 0.99. A more preferable range is 0.40 to 0.97, and a further more preferable range is from 0.50 to 0.80. It is not preferable in view of cost that the ratio is less than 0.30, since the sea component removing rate would be larger. Furthermore, it is not preferable either in view of spinning stability that the ratio is more than 0.99, since island components would be likely to be combined with each other.

Moreover, the polymers used are not especially limited. For example, as the island component, a polyester, polyamide, polypropylene, polyethylene or the like can be adequately used in response to the application. However, in view of dyeability and strength, a polyester or polyamide is preferable.

The polyester that can be used is a polymer synthesized from a dicarboxylic acid or any of its ester forming derivatives and a diol or any of its ester forming derivatives, and is not especially limited if it can be used in the conjugate fibers. Examples of the polyester include polyethylene terephthalate, polytrimethylene terephthalate, polytetramethylene terephthalate, polycyclohexylene dimethylene terephthalate, polyethylene-2,6-naphthalene dicarboxylate, polyethylene-1,2-bis(2-chlorophenoxy)ethane-4,4'-dicarboxylate, etc. Above all, the most generally used polyethylene terephthalate or a polyester copolymer mainly containing ethylene terephthalate units can be suitably used.

The polyamide which can be used can be a polymer having amide bonds such as nylon 6, nylon 66, nylon 610, nylon 12 or the like.

The polymer used as the sea component of the islands-in-sea type conjugate fibers is not especially limited, if it has chemical properties of being higher in dissolvability and decomposability than the polymer constituting the island component. Though depending on the polymer used to constitute the island component, examples of the polymer used as the sea component include polyolefins such as polyethylene and polystyrene, and polyesters copolymerized. with 5-sodiumsulfoisophthalic acid, polyethylene glycol, sodium dodecylbenzenesulfonate, bisphenol A compound, isophthalic acid, adipic acid, dodecancdioic acid, cyclohexylcarboxylic acid or the like. In view of spinning stability, polystyrene is preferable, but in view of easy removal without using any organic solvent, a copolyester having sulfone groups is preferable. It is preferable that the copolymerization rate is 5 mol % or more in view of processing rate and stability and 20 mol % or less is preferable in view of polymerizability, spinnability and stretchability. A preferable combination consists of a polyester and/or polyamide as the island component and polystyrene or a copolyester having sulfone groups as the sea component.

To these polymers, for enhancing the hiding power, inorganic particles such as titanium oxide particles can be added. In addition, a lubricant, pigment, thermal stabilizer, ultraviolet light absorber, electrically conducting agent, heat-storing material, antimicrobial agent, etc. can also be added for various purposes-.

The method for obtaining the islands-in-sea type conjugate fibers is not especially limited. For example, undrawn yarns obtained by using the die stated for the method of (4) can be taken up and stretched in one to three stages using wet heat and/or dry heat, to obtain the fibers.

The nonwoven fabric must be a nonwoven fabric containing staple fibers in view of excellent quality and hand. In this regard, the aforesaid fibers must be cut at an adequate length, and the length should be 10 cm or less, considering productivity and the hand of the obtained fabric. Preferable range. is 7 cm or less. Fibers with a fiber length of more than 10 cm can also be contained if the effects are not impaired. The lower limit of the length is not especially specified and can be decided, as required, in response to the nonwoven fabric producing method. However, if the length is less than 0.1 cm, fibers coming off would increase and such properties as strength and abrasion resistance would tend to be poor. So, it is preferable that the length is 0.1 cm or more. In addition, it is preferable that the staple fibers are entangled with each other in view of compactness and strength. Meanwhile, in the nonwoven fabric containing ultra-fine fibers, considering the physical properties such as strength and quality of the leather-like sheet obtained from the nonwoven fabric, it is not preferable that the respective staple fibers are the same in length. That is, it is preferable that shorter fibers and longer fibers exist together in a fiber length range from 0.1 to 10 cm. A nonwoven fabric in which shorter fibers in a length range from 0.1 to 1 cm, preferably 0.1 to 0.5 cm and longer fibers in a length range from 1 to 10 cm, preferably 2 to 7 cm exist together can be, exemplified. In such a nonwoven fabric, for example, fibers shorter in length contribute to better surface appearance and higher density, while fibers longer in length contribute to higher physical properties.

The method for mixing fibers different in length as described above is not especially limited. The following methods are available: methods in which islands-in-sea type conjugate fibers different in the length of island fibers are used; methods in which staple fibers with various lengths are mixed; methods in which a formed nonwoven fabric is processed to make the fibers different in length; etc. Any method in which a formed nonwoven fabric is processed to make the fibers different in length can be preferably employed for such reasons that especially a nonwoven fabric with fibers different in length mixed can be easily obtained and that fibers with lengths suitable for the two entangling means described later can be obtained in the respective stages. For example, if a method in which a nonwoven fabric is split perpendicularly to the thickness direction for separation into two or more sheets (splitting) is used, a nonwoven fabric having fibers with various lengths can be easily produced after splitting, even if the fibers are equal in length before splitting. The splitting in this case is a treatment similar to the splitting step in general natural leather, and can be performed using, for example, a splitting machine produced by Murota Seisakusho K.K.

Meanwhile, in the case where splittable fibers are used, two or more components are conjugated mainly in the die, and the subsequent processing can be performed as described for the aforesaid method for producing the islands-in-sea type conjugate fibers.

As the method for producing the nonwoven fabric containing ultra-fine fibers, a method of needle punching and hydro-entanglement in combination can be preferably employed. A nonwoven fabric with a fiber length of 1 to 10 cm, preferably 3 to 7 cm is formed at the time of needle punching, and is split perpendicularly to the thickness direction for separation into two or more sheets, to form short fibers, and hydro-entanglement is performed. As a result, a nonwoven fabric containing ultra-fine fibers with excellent physical properties and dense surface appearance can be easily obtained.

As the method for forming a nonwoven fabric from staple fibers, a dry process in which a web is obtained using a card, crosslapper or random webber or a wet process such as a paper making method can be used. However, a dry process is preferable, since the two entangling methods of needle punching and hydro-entanglement can be easily combined. When the entanglement is performed, the web can also be integrated with another woven fabric, knitted fabric or nonwoven fabric for allowing moderate elongation or arresting the elongation, or for improving the physical properties such as strength of the obtained nonwoven fabric.

The weight per unit area of the nonwoven fabric containing ultra-fine fibers is from 100 to 550 g/m$^2$. A preferable range is from 120 to 450 g/m$^2$, and a more preferable range is from 140 to 350 g/m$^2$. It is not preferable that the weight per unit area is less than 100 g/m$^2$ for such reasons that the nonwoven fabric per se would be poor in physical properties. And in the case where a woven fabric and/or knitted fabric is laminated, the surface appearance would be lowered because the appearance of the woven fabric and/or knitted fabric is likely to be visible on the surface. Furthermore, it is not preferable either that the weight per unit area is more than 550 g/m$^2$, since the abrasion resistance would tend to decline. Furthermore, the apparent density should be from 0.280 to 0.700 g/cm$^3$. A preferable range is from 0.300 to 0.600 g/cm$^3$, and a more preferable range is from 0.330 to 0.500 g/cm$^3$. If the apparent density is less than 0.280 g/cm$^3$, in the case where dyeing is performed, breaking, fluffing and the like occur, and it is difficult to obtain sufficient strength and abrasion resistance. It is not preferable that the apparent density more than 0.700 g/cm$^3$, since the hand would become paper-like.

Herein, the apparent density is obtained by measuring the weights per unit area of specimens according to JIS L 1096 8.4.2 (1999), measuring the thicknesses of the specimens, calculating apparent densities, and averaging the apparent densities. For measuring the thickness, a dial thickness gauge (trade name "Peacock H" produced by Ozaki Mfg. Co., Ltd.) was used to measure at ten sample points, and the average value was used. The apparent density refers to the apparent density of a fiber material. Therefore, for example, in the case of a nonwoven fabric made of a fiber material impregnated with a resin, the apparent density of the fiber material excluding the resin is used.

Furthermore, the nonwoven fabric containing ultra-fine fibers has tensile strengths of 70 N/cm or more in the length and width directions. It is preferable that the tensile strengths both in the length and width directions are 80 N/cm or more. It is not preferable that for use as .a leather-like sheet, the tensile strength in either the length or width direction is less than 70 N/cm, since the adaptability to the subsequent treatment process would become poor with a tendency to cause breaking, size change, etc. Furthermore, there would arise such a problem that for use as a leather-like sheet, a large amount of a polyurethane must be added for obtaining sufficient physical properties. The upper limit of the tensile strength is not especially specified, but is usually 200 N/cm or less. To measure the tensile strength, a 5 cm wide and 20 cm long sample is taken and elongated at a rate of 10 cm/min at a grab interval of 10 cm using a constant elongation rate type tensile tester, according to JIS L 1096 8.12.1 (1999). From the obtained value, the load per 1 cm width is calculated as the tensile strength (in N/cm). To obtain the strength, it is preferable that the strength of the fibers used is 2 cN/decitex or more.

The tear strengths of the nonwoven fabric containing ultra-fine fibers are from 3 to 50 N both in the length and in width directions. A preferable range is from 5 to 30 N. If the tear strength in either the length or width direction is less than 3 N, the adaptability to processing becomes poor, making stable production difficult. On the contrary, it is not preferable that the tear strength in either the length or width direction is more than 50 N, since the nonwoven fabric would tend to be generally too soft, making it difficult to achieve the balance between the tear strength and the hand. Herein, the tear strength is measured based on the D method (pendulum method) of JIS L 1096 8.15.1 (1999).

The desired tear strength can be obtained by adjusting the apparent density in an appropriate range, and in general, a higher density tends to lower the strength.

It is preferable that the nonwoven fabric containing ultra-fine fibers is 8 N/cm or more in the 10% modulus in the length direction, for preventing the deformation and breaking of the sheet in the subsequent process performed in response to the application. More preferable range is 10 N/cm or more. The upper limit is not especially specified. However, it is not preferable that the 10% modulus is more than 50 N/cm, since the hand would become hard to lower the working convenience. In the case where the aforesaid production method is used, if needle punching and hydro-entanglement are performed sufficiently, the value: of 10% modulus can be enhanced. Moreover, the 10% modulus can be enhanced also by laminating a woven fabric and/or knitted fabric,. etc.

Furthermore, the value of 10% modulus is of course lowered by the dyeing process and the massaging process. However, if the nonwoven fabric Containing ultra-fine fibers conforms to the aforesaid range before these processes-are-performed, better adaptability to processing and a good quality leather-like sheet can be easily obtained.

Meanwhile, the 10% modulus is measured as described for the method of measuring the tensile strength, and the strength at 10% elongation is employed as the 10% modulus.

Even in the case where the nonwoven fabric containing ultra-fine fibers obtained as described above is made of a fiber material only, the entanglement is, strong, and breaking or the like is unlikely to occur even under strong massaging action, for example, as caused by a jet dyeing machine. So, the nonwoven fabric has good adaptability to processing. Therefore, the nonwoven fabric containing ultra-fine fibers can be suitably used as a base sheet of a leather-like sheet. For example, if the nonwoven fabric containing ultra-fine fibers is used, a leather-like sheet with a compactness can be obtained without using an elastomer such as a polyurethane or by using a smaller amount of an elastomer than as used hitherto. For example, if 10 wt % or less of an elastomer is added to the fiber material, a leather-like sheet with a compactness can be produced. Furthermore, even a nonwoven fabric substantially not containing an elastomer can be used to produce a leather-like sheet good in compactness, hand, physical properties and quality. Therefore, an elastomer can be used, as required, in response to the intended hand, physical properties, etc.

Moreover, since the nonwoven fabric containing ultra-fine fibers has high physical properties and a dense structure, it can be applied not only as a leather-like sheet but also as abrasive cloth, filter, wiper, heat insulating material, sound absorbing material, etc.

An example of the method for producing the nonwoven fabric containing ultra-fine fibers is described below.

In a preferable method for obtaining the nonwoven fabric, containing ultra-fine fibers, composite fibers of 1 to 10 decitex convertible into bundles of ultra-fine fibers are needle-punched to produce a nonwoven fabric containing composite fibers, and then hydro-entanglement is performed at a pressure of at least 10 MPa or more, for example, by means of water jet punching. The combination of needle punching and hydro-entanglement can achieve advanced entanglement.

It is preferable that the needle punching of the nonwoven fabric containing composite fibers can achieve an apparent density of 0.120 to 0.300 g/cm$^3$. A more preferable range is from 0.150 to 0.250 g/cm$^3$. If the apparent density is less than 0.120 g/cm$^3$, entanglement would be insufficient, and it is difficult to obtain the intended physical properties. The upper limit is not especially specified, but it is not preferable that the apparent density is more than 0.300 g/cm$^3$, since such problems as needle breaking and remaining needle holes would occur.

Furthermore, in the case where needle punching is performed, it is preferable that the fiber fineness of the composite fibers is from 1 to 10 decitex. A preferable range is from 2 to 8 decitex, and a more preferable range is from 2 to 6 decitex. If the fiber fineness is less than 1 decitex or more than 10 decitex, the entanglement by needle punching would be insufficient, and it would be difficult to obtain a nonwoven fabric containing ultra-fine fibers with good physical properties.

It is preferable that the needle punching makes the fibers sufficiently entangled with each other rather than merely achieving temporary tacking for obtaining good adaptability to processing. Therefore, it is preferable that the punching density is 100 needles/$cm^2$ or more. More preferable range is 500 needles/$cm^2$ or more, and further more preferable range is 1000 needles/$cm^2$ or more.

It is preferable that the nonwoven fabric containing composite fibers obtained as described above is shrunk by dry heat and/or wet heat for being more highly densified.

Then, it is preferable to perform hydro-entanglement after a treatment for forming ultra-fine fibers, or simultaneously with a treatment for forming ultra-fine fibers, or simultaneously with and after a treatment for forming ultra-fine fibers, for entangling the ultra-fine fibers with each other. The hydro-entanglement can be used also as a treatment for forming ultra-fine fibers, but it is preferable that hydro-entanglement is performed also after at least most of the treatment for forming ultra-fine fibers has been completed, since the entanglement between ultra-fine fibers can be further promoted. It is further preferable that hydro-entanglement is performed after completion the treatment for forming ultra-fine fibers.

The method of the treatment for forming ultra-fine fibers is not especially limited, and for example, a mechanical method or a chemical method can be used. A mechanical method refers to a method in which physical stimulation is given for forming ultra-fine fibers. Examples of the method include a method of applying impact such as said needle punching or water jet punching, a method of pressurizing between rollers, an ultrasonic treatment method, etc. Furthermore, the chemical method is, for example, a method in which a chemical substance is used to swell, decompose, dissolve or change in any other way at least one component of the composite fibers. Especially a method comprising the steps of producing a nonwoven fabric containing composite fibers from the composite fibers convertible into bundles of ultra-fine fibers containing an alkali decomposable sea component, and subsequently treating the nonwoven fabric with a neutral or alkaline aqueous solution for forming ultra-fine fibers is one of preferable modes, since it is not necessary to use any solvent preferably in view of working environment. The neutral to alkaline aqueous solution in this case refers to an aqueous solution showing pH 6 to 14, and the chemical substance used and the like are not especially limited. For example, an aqueous solution containing an organic or inorganic salt showing a pH in said range can be used, and examples of the salt include alkali metal salts such as sodium hydroxide, potassium hydroxide, lithium hydroxide, sodium carbonate and sodium hydrogencarbonate, alkaline earth metals such as calcium hydroxide and magnesium hydroxide, etc. Furthermore, as required, an amine such as triethanolamine, diethanolamine or monoethanolamine, weight loss promoter, carrier and the like can also be used together. Above all sodium hydroxide is preferable in view of price, easy handling, etc. Furthermore, it is preferable that after the sheet has been treated with the aforesaid neutral to alkaline aqueous solution, neutralization and washing are performed as required to remove the remaining chemical substances, decomposition products, etc., before drying.

Methods for performing the ultra-fine fiber formation and hydro-entanglement simultaneously include, for example, a method comprising the step of treating conjugate fibers containing a water-soluble sea component by water jet punching for removing the sea component and achieving the entanglement, and a method comprising the steps of passing conjugate fibers containing two or more components different in alkali decomposition rate through an alkaline treatment solution, for decomposing an easily dissolvable component, and treating them by water jet punching for finally removing the component and achieving the entanglement.

As hydro-entanglement, water jet punching is preferable in view of working environment. In this case, it is preferable that water is jetted as columnar streams. The columnar streams can be obtained by jetting water from a nozzle having holes with a diameter of 0.06 to 1.0 mm at a pressure of 1 to 60 MPa. For achieving efficient entanglement and good surface appearance, it is preferable that nozzle holes with a diameter of 0.06 to 0.15 mm are arranged at intervals of 5 mm or less. It is more preferable that nozzle holes with a diameter of 0.06 to 0.12 mm are arranged at intervals of 1 mm or less. In the case where the treatment is performed plural times, it is not required that all the nozzle holes are the same. For example, nozzle holes with a large diameter and nozzle holes with a small diameter can also be used together, though it is preferable to use the nozzle holes as described above at least once. It is not preferable that the diameter is especially, more than 0.15 mm, since the capability to entangle ultra-fine fibers with each other would declines, making the surface likely to be fluffy and also poorly smooth. Therefore, smaller nozzle holes are preferable, but it is not preferable either that the nozzle holes are less than 0.06 mm, since the nozzle holes would be likely to be clogged to pose a problem that the necessity for highly filtering water raises the cost. Furthermore, for the purpose of achieving entanglement uniform in the thickness direction and/or for the purpose of improving the surface smoothness of the nonwoven fabric, it is preferable to repeat the treatment many times. Moreover, it is preferable to decide the water jet pressure in reference to the weight per unit area of the nonwoven fabric, and to select a higher pressure when the weight per unit area is higher. For the purpose of highly entangling the ultra-fine fibers with each other, it is preferable to treat at a pressure of 10 MPa or more at least once. More preferable range is 15 MPa or more. Though the upper limit of the pressure is not especially specified, a higher pressure involves a higher cost, and a low weight per unit area may make the nonwoven fabric uneven or may cause the fibers to be cut and napped. Preferable range is 40 MPa or less, and more preferable range is 30 MPa or less. For example in the case of ultra-fine fibers obtained from conjugate fibers, bundles consisting of ultra-fine fibers are generally entangled with each other. However, in this disclosure as described above, in the obtained nonwoven fabric containing ultra-fine fibers, the ultra-fine fibers are entangled with each other to such an extent that the entanglement between the bundles of ultra-fine fibers is little observed. Furthermore, because of it, surface properties such as abrasion resistance can also be improved. Meanwhile, the water jet punching can also be preceded by water immersion treatment. Furthermore, as a method to improve the surface appearance, the nozzle head and the nonwoven fabric can be moved relatively to each other or a wire net or the like can be inserted between the nonwoven fabric and the nozzle after completion of entanglement, for performing water spray treatment. Moreover, it is preferable to split the nonwoven fabric perpendicularly to the thickness direction into two or more sheets before hydro-entanglement. In this way, it is desirable to entangle the ultra-fine fibers with each other to achieve a 10% modulus of preferably 8 N/cm or more, more preferably 10 N/cm or more in the length direction.

Furthermore, it is preferable to reduce the thickness to 0.1 to 0.8 time at a temperature of 100 to 250° C. using a calender after completion of hydro-entanglement for such reasons that the apparent density of fibers can be further increased, and that in the case where the nonwoven fabric containing ultra-fine fibers is used as a leather-like sheet, higher abrasion resistance and dense hand can be obtained. Pressing to less than 0.1 time is not preferable, since the hand would become too hard. Pressing to larger than 0.8 time is allowed, but the effect achieved by the pressing is small and the thickness is recovered, for example, in a dyeing process. Furthermore, pressing at lower than 100° C. is not preferable, since the effect of pressing would be small. Moreover, pressing at a temperature higher than 250° C. is not preferable either, since fusion bonding or the like would tend to harden the hand. Meanwhile, pressing before hydro-entanglement is not preferable, since the hydro-entanglement would be unlikely to work.

We have paid attention to the difference between the fibers likely to be entangled by needle punching and the fibers likely to be entangled by hydro-entanglement, and it has been found that especially the above-mentioned process can be used to easily produce the excellent nonwoven fabric containing ultra-fine fibers. That is, this disclosure uses the trends that the fibers as thick as 1 to 10 decitex can be excellently entangled by needle punching and that the fibers as ultra-fine as 0.0001 to 0.5 decitex can be excellently entangled by hydro-entanglement. For combining these fiber finenesses and entangling methods, it is preferable that composite fibers with a fineness of 1 to 10 decitex convertible into bundles of ultra-fine fibers are sufficiently entangled by needle punching and subsequently treated by hydro-entanglement after, or while, or while and after they are treated to form ultra-fine fibers of 0.0001 to 0.5 decitex.

The leather-like sheet is explained below.

The leather-like sheet in one aspect is a leather-like sheet comprises a nonwoven fabric and is substantially made of a fiber material of a non-elastic polymer. The leather-like sheet in this case refers to a sheet with excellent surface appearance such as suede, nubuck or grain side like natural leather. An especially preferable leather-like sheet has suede-like appearance such as suede or nubuck with smooth touch and excellent lighting effects. In general, a leather-like sheet called synthetic leather or artificial leather comprises an elastomer such as a polyurethane and a fiber material. However, the leather-like sheet in this aspect does not substantially contain any elastomer such as a polyurethane, and is substantially made of a fiber material of a non-elastic polymer. The fibers of a non-elastic polymer in this case mean the fibers of a polymer excluding fibers excellent in rubbery elasticity such as polyether ester-based fibers and polyurethane-based fibers like so-called spandex. Particularly they include the fibers made of a polyester, polyamide, polypropylene, polyethylene or the like. The polymers enumerated before as polymers usable to constitute the nonwoven fabric containing ultra-fine fibers are suitable. Since the leather-like sheet is substantially made of a non-elastic polymer, it does not have any rubbery hand but has hand with a compactness. In addition, various effects such as recyclability, high color formability, high light resistance and high yellowing resistance can be achieved in the fiber material. Especially for chemical recycling, it is preferable that the fiber material is polyethylene terephthalate or nylon 6. Meanwhile, it is most preferable that the leather-like sheet in this aspect does not contain any elastomer such as polyether ester-based fibers or polyurethane-based fibers like spandex at all. However, the leather-like sheet can also contain an elastomer to such an extent that the effects of are not impaired. Moreover, the leather-like sheet can also contain functional chemical substances such as a dye, softening agent, hand regulating agent, antipilling agent, antimicrobial agent, deodorant, water repellent, light resisting agent and weather resisting agent.

The leather-like sheet in this aspect must comprise at least a nonwoven fabric, and as a result, hand like leather can be obtained. If the leather-like sheet contains a nonwoven fabric, it can also contain a knitted or woven fabric as laminated or in any other way. However, in the case of a leather-like sheet formed of a knitted or woven fabric only, it is difficult to obtain good hand.

Furthermore, the leather-like sheet can be, for example, either grain leather-like or suede-like, but in the case where it is made of a fiber material only, an especially suede-like sheet can have better surface appearance. So, it is preferable that the sheet is raised at least one surface. For obtaining a grain leather-like surface, a method of forming an ultra-high density fiber layer on the surface is preferable unlike the conventional sheet having a polyurethane or other resin layer formed. Meanwhile, the leather-like sheet is substantially made of a fiber material, but unlike a mere nonwoven fabric, it has surface appearance similar to that of general natural leather or artificial leather.

It is especially preferable that such a leather-like sheet is made of ultra-fine fibers with a fiber fineness of 0.0001 to 0.5 decitex. Amore preferable range is from 0.005 to 0.15 decitex, and a further more preferable range is from 0.005 to 0.1 decitex.

The means for obtaining such a leather-like sheet made of a fiber Material is not especially limited. For example, the above-mentioned nonwoven fabric containing ultra-fine fibers can be used to produce the leather-like sheet. It is not preferable that the fiber fineness is less than 0.0001 decitex, since the strength and the color formability would decline. It is not preferable either that the fineness is more than 0.5 decitex for such reasons that the hand would become hard and that the surface appearance would become also poor. Meanwhile, the leather-like sheet can also contain fibers with fiber finenesses outside said range to such an extent that the effects are not impaired.

Furthermore, it is preferable that the leather-like sheet is dyed.

The leather-like sheet in another aspect contains a dyed nonwoven fabric containing ultra-fine fibers with a fiber fineness of 0.0001 to 0.5 decitex, a fiber length of 10 cm or less, a weight per unit area of 100 to 550 g/m$^2$, and an apparent density of 0.230 to 0.700 g/cm$^3$, and has a tear strength of 3 to 50 N and satisfies the following formula:

$$\text{Tensile strength (N/cm)} \geqq 0.45 \times \text{Weight per unit area (g/m}^2\text{)} - 40$$

The fiber fineness is from 0.0001 to 0.5 decitex. A preferable range is from 0.001 to 0.3 decitex, and a more preferable range is from 0.005 to 0.15 decitex. A further more preferable range is from 0.005 to 0.1 decitex. It is not preferable that the fiber fineness is less than 0.0001 decitex, since the strength would decline. Furthermore, it is not preferable either that the fineness is more than 0.5 decitex, since such problems as hard hand and poor surface appearance would occur. Moreover, the leather-like sheet may also contain fibers with finenesses outside said range to such an extent that the effects are not impaired.

Furthermore, in view of excellent, quality and hand, the leather-like sheet contains a nonwoven fabric containing staple fibers with a fiber length of 10 cm or less. A fiber length of 7 cm or less is preferable. Fibers with a fiber length of more than 10 cm can also be contained if the effects are not impaired. The lower limit is not especially specified, and can be decided as required in reference to the production method of the nonwoven fabric. It is not preferable that the fiber length is less than 0.1 cm for such reasons that more fibers would come off and that properties such as strength and abrasion resistance would tend to be poor. Moreover, considering, for example, physical properties such as strength and quality, it is not preferable that the respective fibers are the same in length. That is, it is preferable that shorter fibers and longer fibers exist together with the fiber lengths kept in a range from 0.1 to 10 cm. A nonwoven fabric in which shorter fibers of 0.1 to 1 cm, preferably 0.1 to 0.5 cm and longer fibers of 1 to 10 cm, preferably 2 to 7 cm exist together can be exemplified. In this case, for example, the shorter fibers serve for better surface appearance and higher density, while the long fibers serve for higher physical properties.

The weight per unit area of the leather-like sheet is from 100 to 550 g/m$^2$. A preferable range is from 120 to 450 g/m$^2$, and a more preferable range is from 140 to 350 g/m$^2$. It is not preferable that the weight per unit area is less than 100 g/m$^2$ for such reasons that physical properties would become poor, and that in the case where a woven fabric and/or a knitted fabric is laminated, the appearance of the woven fabric and/or the knitted fabric would be more easily visible on the surface, to lower the surface appearance. Furthermore, it is not preferable either that the weight per unit area is more than 550 g/m$^2$, since the abrasion resistance would tend to decline. Furthermore, the apparent density of the leather-like sheet is from 0.230 to 0.700 g/cm$^3$. A preferable range is from 0.280 to 0.650 g/cm$^3$, and a more preferable range is from 0.300 to 0.600 g/cm$^3$. It is not preferable that the apparent density is less than 0.230 g/cm$^3$, since especially the abrasion resistance would decline. Furthermore, it is not preferable either that the apparent density is more than 0.700 g/cm$^3$, since the hand would become hard.

The tear strengths of the leather-like sheet in the length and width directions are in a range from 3 to 50 N. A preferable range is from 5 to 30 N, and a more preferable range is from 10 to 25 N. If the tear strength is less than 3 N, the leather-like sheet is likely to be broken, and the adaptability to processing declines, making stable production difficult. It is not preferable that the tear strength is more than 50 N for such reasons that the leather-like sheet would tend to be generally too soft and that the balance between the tear strength and the hand is difficult to achieve. The tear strength can be achieved if the apparent density is adjusted in an appropriate range, and in general, a higher density tends to lower the strength. Furthermore, if massaging process or the like is used for softening, the tear strength can also, be enhanced.

The tensile strengths in the length and width directions must also satisfy the following formula:

$$\text{Tensile strength (N/cm)} \geqq 0.45 \times \text{Weight per unit area (g/m}^2\text{)} - 40$$

It is not preferable that the tensile strengths are in a range not satisfying the formula, since such a problem would occurs that the leather-like sheet is broken especially if it does not substantially contain any elastomer. Furthermore, though the upper limit is not especially specified, it is usually 250 N/cm or less.

Furthermore, it is preferable that the tensile strengths both in the length and width directions satisfy the following formula:

$$\text{Tensile strength (N/cm)} \geqq 0.5 \times \text{Weight per unit area (g/m}^2\text{)} - 40$$

Still furthermore, it is preferable that the tensile strengths in the length and width directions satisfy the following formula:

$$\text{Tensile strength (N/cm)} \geqq 0.6 \times \text{Weight per unit area (g/m}^2\text{)} - 40$$

It is preferable that the leather-like sheet does not contain any elastomer such as a polyurethane and is substantially made of a fiber material, since it can have hand with a compactness and excellent recyclability. Furthermore, similarly, it is also preferable that the fiber material does not contain fibers of an elastic polymer such as so-called spandex but contains fibers made of a non-elastic polymer.

Moreover, the leather-like sheet can be, for example, either grain leather-like or suede-like, but since good surface appearance can be obtained if the sheet is suede-like, it is preferable that at least one surface of the sheet is raised.

Still furthermore, it is preferable in view of excellent abrasion resistance that the fiber material constituting the leather-like sheet contains fine particles. A structure in which the ultra-fine fibers of the fiber material are entangled with each other is especially preferable. The existence of the fine particles can provide a large abrasion resistance enhancing effect.

The material of the fine particles referred to here is not especially limited, if they are insoluble in water. Examples of the fine particles include inorganic substances such as silica, titanium oxide, aluminum and mica and organic substances such as melamine resin. Furthermore, it is preferable that the average particle diameter of the fine particles is from 0.001 to 30 μm. A more preferable range is from 0.01 to 20 μm, and a further more preferable range is from 0.05 to 10 μm. If the average particle diameter is less than 0.001 μm, it is difficult to obtain the expected effect, and if the diameter is more than 30 μm, the particles come off from the fibers to lower the washing durability. Herein, the average particle diameter can be measured by a measuring method suitable for the material and size of the particles, for example, BET method, laser method or Coulter method.

The amount of the fine particles used can be adequately adjusted in a range in which the effects can be exhibited. A preferable range is from 0.01 to 10 wt %, and a more preferable range is from 0.02 to 5 wt %. A further more preferable range is from 0.05 to 1 wt %. If the amount is 0.01 wt % or more, the effect of enhancing the abrasion resistance can be remarkably exhibited, and a larger amount tends to make the effect larger. However, more than 10 wt % is not preferable, since the hand would become hard. Meanwhile, for preventing the fine particles from coming off and for improving durability, it is preferable to use a small amount of a resin together.

Moreover, to obtain soft hand and smooth surface touch, it is preferable that the leather-like sheet contains a softening agent. The softening agent is not especially limited, and is adequately selected from those generally used in woven and knitted fabrics in response to the material of the fibers. For example, any one can be adequately selected from those enumerated under titles of hand adjusting agents and soft finishing agents in Senshoku-Note Dyeing Notes), 23$^{rd}$ edition (issued by Shikisensha Co., Ltd. on Aug. 31, 2002). Above all, in view of excellent softness effect, a silicone-based emulsion is preferable, and an amino-modified or epoxy-modified silicone-based emulsion is more preferable. If the softening agent is contained, the abrasion resistance tends to decline. Therefore, it is preferable to adjust the amount of the softening agent and the amount of the fine particles adequately while the balance between the intended hand and the abrasion resistance is achieved. So, the amount is not especially limited. If the amount is too small, the intended effect cannot be exhibited, and if the amount is too large, stickiness occurs. So, a range from 0.01 to 10 wt % is preferable.

The leather-like sheet in any aspect should be 20 mg or less in the abrasion loss of the test fabric after 20000 times of abrasion in an abrasion test measured according to JIS L 1096 (1999) {8.17.5 Method E (Martindale Method) Load for Furniture (12 kPa)}. Preferable range is 15 mg or less, and more preferable range is 10 mg or, less. It is preferable that the number of pills is 5 or less. More preferable range is 3 or less, and further more preferable range is 1 or less. It is not preferable that the abrasion loss is more, than 20 mg, since nap would tend to adhere to the clothing, etc. in actual use. On the other hand, the lower limit is not especially specified, and a leather-like sheet with little abrasion loss can also be obtained as the leather-like sheet. It is not preferable that the number of formed pills is more than 5, since the appearance of the used sheet would change to lower the surface appearance.

To obtain the abrasion resistance, especially the apparent density is important, and at a higher density, better abrasion resistance can be obtained. Furthermore, if fine particles are added, the abrasion resistance can be greatly enhanced, and if a softening agent or the like is used in a large amount on the contrary, the abrasion resistance tends to decline. Therefore, it is necessary to set these conditions while the balance between the abrasion resistance and the hand is achieved.

In the leather-like sheet in any aspect, in view of dyeability and strength, it is preferable that the ultra-fine fibers are made of a polyester and/or .a polyamide.

In view of compactness, strength and quality, it is preferable that the leather-like sheet in any aspect contains ultra-fine fibers with a fiber length of 1 to 10 cm and has the ultra-fine fibers entangled with each other.

The method for producing a leather-like sheet is not especially limited. However, since the intended physical properties can be easily obtained, it is preferable to dye the above-mentioned nonwoven fabric containing ultra-fine fibers, for producing the leather-like sheet. If the above-mentioned nonwoven fabric containing ultra-fine fibers is used, the various features of the leather-like sheet can be satisfied.

Furthermore, the method for producing a leather-like sheet in another aspect comprises the steps of needle-punching composite fibers convertible into bundles of ultra-fine fibers of 0.0001 to .0.5 decitex, for entangling them, converting them into bundles of ultra-fine fibers for forming a nonwoven fabric containing ultra-fine fibers, subsequently treating the nonwoven fabric by hydro-entanglement at a pressure of at least 10 MPa, for re-entangling, and then dyeing. The particular means are the same as those in the method for producing a nonwoven fabric containing ultra-fine fibers, and they are followed by dyeing.

In the case where an elastomer such as a polyurethane is added when the leather-like sheet is produced, a nonwoven fabric containing: ultra-fine fibers is produced and subsequently impregnated with the elastomer. The elastomer can be adequately selected from various elastomers, considering the intended hand, physical properties and quality. Examples of the elastomer include a polyurethane, acryl, styrene-butadiene, etc. Among them, in view of softness, strength, quality, etc., it is preferable to use a polyurethane. The method for producing the polyurethane is not especially limited, and it can be produced by any known conventional method, i.e., by letting a polymer polyol, diisocyanate and chain extender react adequately. Furthermore, either a solvent reaction or an aqueous dispersion reaction can be used, but in view of working environment, an aqueous dispersion reaction is preferable.

However, it is preferable that the leather-like sheet is mainly made of a fiber material substantially not containing any elastomer for such reasons that the features of the nonwoven fabric containing ultra-fine fibers can be exhibited more clearly and that the leather-like sheet is superior to the conventional leather-like sheets. Furthermore, it is preferable that the fiber material is substantially made of fibers of a non-elastic polymer.

The method for dyeing the nonwoven fabric containing ultra-fine fibers is not especially limited, and the dyeing machine used can also be a jet dyeing machine, thermosol dyeing machine, high pressure jigger dyeing machine or the like. However, it is preferable to dye using a jet dyeing machine, since the obtained leather-like sheet can have excellent hand.

Moreover, in the leather-like sheet mainly made of a fiber material, for obtaining a semi-grain leather-like surface, a method comprising the steps of dyeing and pressing to 0.1 to 0.8 time in thickness can be employed. As a result, the surface becomes semi-grain leather-like and the abrasion resistance can also be enhanced. The pressing can be performed either before dyeing or after dyeing.

Still furthermore, for obtaining a suede-like or nubuck-like leather-like sheet, it is preferable to raise the surface of the sheet using sand paper, brush, etc. The raising can be performed before dyeing or after dyeing or before and after dyeing. A method in which said pressing is followed by said raising is preferable for enhancing the abrasion resistance.

It is preferable that the method for producing a leather-like sheet comprises the step of adding fine particles to the fiber material for the purpose of enhancing the abrasion resistance. If the fine particles are added to the fiber material, an effect of giving such hand as a dry effect or creaky effect can also be obtained. The means for adding the fine particles is not especially limited, and can be selected, as required, from padding, use of a jet dyeing machine or jigger dyeing machine, spraying, etc.

Furthermore for obtaining soft hand and smooth surface touch, it is also preferable to let the method comprise the step of adding a softening agent to the fiber material. The means for adding the softening agent is not especially limited either, and can be selected from padding, use of a jet dyeing machine or jigger dyeing machine, spraying, etc. In view of production cost, it is preferable to add the softening agent simultaneously with the fine particles.

Meanwhile, it is preferable that the fine particles and the softening agent are added after dyeing. Adding them before dyeing is not preferable for such reasons that they may come off during dyeing to reduce the effects and that dyeing irregularity may occur. Furthermore, since raising the surface of a nonwoven fabric containing fine particles tends to be difficult, it is preferable to add the Tine particles after completion of raising if raising is necessary.

EXAMPLES

This disclosure is explained below in more detail in reference to examples. The physical properties in the examples were measured according to the methods described below.

(1) Weight Per Unit Area and Apparent Density

The weight per unit area was measured according to the method of JIS L 1096 8.4.2 (1999). Furthermore, the thickness was measured using a dial thickness gauge (trade name "Peacock H" produced by Ozaki Mfg. Co., Ltd.), and from the value of the weight per unit area, the apparent density was obtained by calculation.

(2) Tensile Strength and 10% Modulus

According to JIS L 1096 8.12.1 (1999), a 5 cm wide 20 cm long sample was taken and elongated at a rate of 10 cm/min at a grab interval of 10 cm using a constant elongation rate type tensile tester. The obtained value was converted into a value per 1 cm width, and this was employed as the tensile strength. Moreover, the strength at 10% elongation in the length direction was employed as the value of 10% modulus.

(3) Tear Strength

The tear strength was measured based on JIS L 1096 8.15.1 (1999) method D (Pendulum Method).

(4) Martindale Abrasion Test

In an abrasion test measured according to JIS L 1096 (1999) {8.17.5 Method E (Martindale Method) Load for Furniture (12 kPa)}, the weight loss of the test fabric after 20000 times of abrasion was evaluated, and the number of pills was visually counted.

Example 1

Islands-in-sea type conjugate fibers with a fiber fineness of 3 decitex and a fiber length of 51 mm and having 36 islands in one fiber, consisting of 45 parts of polystyrene as the sea component and 55 parts of polyethylene terephthalate as the island component were passed through a card and a crosslapper, to produce a web. It was treated, at a punching density of 1500 needles/cm$^2$ using a 1 barb type needle punch, to obtain a nonwoven fabric containing conjugate fibers with an apparent density of 0.210 g/cm$^3$. Then, it was immersed in an aqueous solution containing 12% of polyvinyl alcohol (PVA 1) with a polymerization degree of 500 and a saponification degree of 88% heated to about 95° C., to ensure that 25%, as solid content, of PVA 1, based on the weight of the nonwoven fabric, could be impregnated and shrunk for 2 minutes, and it was dried at 100° C. to perfectly remove water. The obtained sheet was treated with trichlene of about 30° C. till polystyrene was perfectly removed, to obtain ultra-fine fibers with a fiber fineness of about 0.046 decitex. Then, a standard splitting machine produced by Murota Seisakusho K.K. was used to split the nonwoven fabric perpendicularly to the thickness direction for obtaining two sheets, and a water jet punch comprising a nozzle head having holes with a hole diameter of 0.1 arranged at 0.6 mm intervals was used to treat both the front and back surfaces at a treatment speed of 1 m/min at 10MPa and 20 MPa, for removing PVA 1 and achieving entanglement.

The nonwoven fabric containing ultra-fine fibers obtained like this was a dense sheet perfectly free from PVA 1 and having the ultra-fine fibers entangled with each other. The physical properties were evaluated, and the results are shown in Table 1.

Example 2

The same operation as described in Example 1 was performed, except that hot water of 95° C. was used to perfectly remove PVA 1 before performing the hydro-entanglement. The nonwoven fabric containing ultra-fine fibers obtained like this was a dense sheet in which the ultra-fine fibers were entangled with each other as described in Example 1. The physical properties were evaluated, and the results are shown in Table 1.

Example 3

The same operation as described in Example 1 was performed to obtain a nonwoven fabric containing ultra-fine fibers, except that islands-in-sea type conjugate fibers with a fiber fineness of 5 decitex and a fiber length of 51 mm having 25 islands in one fiber, consisting of 20 parts of polystyrene as the sea component and 80 parts of polyethylene terephthalate as the island component (the fineness of the island component was about 0.16 decitex) were used. The nonwoven fabric containing ultra-fine fibers obtained like this was a dense sheet in which the ultra-fine fibers were entangled with each other. The physical properties were evaluated, and the results are shown in Table 1.

Example 4

A nonwoven fabric containing ultra-fine fibers was obtained as described in Example 1, except that nylon 6 was used instead of polyethylene terephthalate as the island component. The nonwoven fabric containing ultra-fine fibers obtained like this was a dense sheet in which the ultra-fine fibers were entangled with each other. The physical properties were evaluated, and the results are shown in Table 1.

Comparative Example 1

Islands-in-sea type conjugate fibers with a fiber fineness of 3 decitex and a fiber length of 51 mm having 36 islands in one fiber, consisting, of 45 parts of polystyrene as the sea component and 55 parts of polyethylene terephthalate as the island component was passed through a card and a crosslapper, to produce a web. It was treated at a: punching density of 1500 needles/cm$^2$ using a 1 barb type needle punch, to obtain a nonwoven fabric containing ultra-fine fibers with an apparent density of 0.210 g/cm$^3$. Subsequently a water jet punch comprising a nozzle head having holes with a hole diameter of 0.1 mm arranged at 0.6 mm intervals was used to treat both the, surfaces at a treatment speed of 1 m/min at 10 MPa and 20 MPa, for achieving entanglement. Then, it was immersed in an aqueous solution containing 12% of PVA 1 heated to about 95° C., to ensure that 25%, as solid content, of PVA 1, based on the weight of the nonwoven fabric, could be impregnated, and shrunk for 2 minutes. It was dried at 100° C. to remove water. The obtained sheet was treated with trichlene of about 30° C. till polystyrene was perfectly removed, and then to remove PVA 1, for obtaining ultra-fine fibers with a fiber fineness of about 0.046 decitex.

The nonwoven fabric containing ultra-fine fibers obtained like this had a structure in which mainly the bundles of ultra-fine fibers were entangled with each other, and was so poor in form stability that it was easily deformed in comparison with those of Examples 1 to 4. The physical properties were evaluated, and the results are shown in Table 1.

Comparative Example 2

The same operation as described in Example 1 was performed, except that PVA 2 with a polymerization degree of 500 and a saponification degree of 98% was used instead of the PVA 1 of Example 1 and that heat treatment for drying was performed at 150° C. for 5 minutes. After completion of hydro-entanglement, about 90% of PVA 2, based on the impregnated amount, remained. So, hot water of 90° C. was further used for extraction removal. The nonwoven fabric containing ultra-fine fibers obtained had a structure in which bundles of ultra-fine fibers were mainly entangled with each other, and it was so poor in form stability that it was easily deformed in comparison with those of Examples 1 to 4. The physical properties were evaluated, and the results are shown in Table 1.

Comparative Example 3

The same operation as described in Example 1 was performed, except that a nozzle head having holes with a hole diameter of 0.25 mm arranged at 2.5 mm intervals was used to treat the front and back surfaces of the web at a speed of 1 m/min at a pressure of 9 MPa twice while the nozzle head was oscillated at an amplitude of 7 mm at 5 Hz in the direction perpendicular to the sheet, as water jet punching conditions. The obtained nonwoven fabric containing ultra-fine fibers had a structure in which the bundles of ultra-fine fibers entangled with each other and the ultra-fine fibers entangled with each existed together. The nonwoven fabric was superior in form stability to those of Comparative Examples 1 and 2 but inferior to those of Examples 1 to 4. The physical properties were evaluated, and the results are shown in Table 1.

Example 5

The nonwoven fabric containing ultra-fine fibers obtained in Example 1 was immersed in an emulsion polyurethane ("Evafanol APC-55" produced by Nicca Chemical Co., Ltd.), to ensure that 5% of it as solid content could be impregnated. It was then heat-treated at 150° C. for 10 minutes. Subsequently, a jet dyeing machine was used to dye the nonwoven fabric with Sumikaron Blue S-BBL200 (produced by Sumika Chemtex Co., Ltd.) at a concentration of 20% owf at 120° C. for 45 minutes. The dyed nonwoven fabric was raised on the surface using sand paper to obtain a suede-like leather-like sheet. The physical properties of the obtained sheet were very strong as shown in Table 2, though the amount of the polyurethane was small.

Example 6

The nonwoven fabric containing ultra-fine fibers obtained in Example 1 was dyed as described in Example 5 using a jet dyeing machine, and pressed to 0.52 time in thickness using a heated calender press at 150° C. at a speed of 5 m/min. Then, the nonwoven fabric was raised on the surface using sand paper, to obtain a leather-like sheet. The obtained sheet had hand with a high compactness, and also had excellent physical properties as shown in Table 2.

Example 7

A nonwoven fabric containing ultra-fine fibers with a weight per unit area of 139 g/m$^2$ and an apparent density of 0.317 g/cm$^3$, in which the ultra-fine fibers were entangled with each other, was produced as described in Example 1, except that the amounts of the fibers used were changed. It was then treated as described in Example 6, to obtain a leather-like sheet. The obtained sheet was thin and soft, but had .hand with a compactness, and also had excellent physical properties as shown in Table 2.

Example 8

A nonwoven fabric containing ultra-fine fibers with a weight per unit area of 495 g/m$^2$ and an apparent density of 0.326 g/cm$^3$, in which the ultra-fine fibers were entangled with each other, was produced as described in Example 1, except that the amounts of the fibers used were changed. It was then treated as described in Example 6, to obtain a leather-like sheet. The obtained sheet was thick and especially had hand with a compactness and also had excellent physical properties as shown in Table 2.

Example 9

A nonwoven fabric containing ultra-fine fibers with a weight per unit area of 181 g/m$^2$ and an apparent density of 0.322 g/cm$^3$, in which ultra-fine fibers were entangled with each other, was obtained as described in Example 1, except that the amounts of the fibers used were changed and that splitting was not performed. It was then treated as described in Example 6, to obtain a leather-like sheet. The obtained sheet had excellent physical properties, especially high abrasion resistance and high tear strength, but was rather poorer in surface appearance than that of Example 7, as shown in Table 2.

Example 10

The nonwoven fabric containing ultra-fine fibers obtained in Example 1 was raised on the surface using sand paper and dyed using a jet dyeing machine. Then, 0.1 wt %, as solid weight, of fine particles (colloidal silica "Snowtex 20L" produced by Nissan Chemical Industries, Ltd., average particle diameter 0.04 to 0.05 μm, BET method) were added. The obtained leather-like sheet was excellent in softness and abrasion resistance. Obtained results are shown in Table 2.

Comparative Example 4

The nonwoven fabric containing ultra-fine fibers obtained in Comparative Example 1 was immersed in emulsion polyurethane ("Evafanol APC-55" produced by Nicca Chemical Co., Ltd.), to ensure that 5% of it as solid content could be impregnated. It was then heat-treated at 150° C. for 10 minutes, and dyed as described in Example 6 using a jet dyeing machine. During dyeing, the nonwoven fabric was broken, and no leather-like sheet could be obtained.

Comparative Example 5

The nonwoven fabric containing ultra-fine fibers obtained in Comparative Example 2 was dyed as described in Example 6 using a jet dyeing machine. During dyeing, the nonwoven fabric was broken, and no leather-like sheet could be obtained.

Comparative Example 6

A 50:50 mixture consisting of polyhexamethylene carbonate diol with a molecular weight of 2000 and polytrimethylene glycol with a molecular weight of 2000, 4,4'-diphenylmethane diamine isocyanate and ethylene glycol were used respectively as a polymer diol, a diisocyanate and a chain extender, to obtain a polyurethane according to a conventional method, and it was diluted by DMF to achieve a solid content of 12 wt %. Furthermore, 1.5 wt % of a benzophenone-based ultraviolet light absorber was added as an additive, to produce a polyurethane immersion solution. Then, a nonwoven fabric containing ultra-fine fibers obtained as described for Comparative Example 1 except that the weight per unit area was 150 g/m$^2$ was immersed in the polyurethane immersion solution, and a squeezing roll was used to adjust the impregnated amount of the immersion solution, to ensure that the solid content of the polyurethane became 60% based on the weight of the fibers. Subsequently, the polyurethane was solidified in a DMF aqueous solution, and then hot water of 85° C. was used to remove DMF. The nonwoven ,fabric was dried at 100° C. and dyed as described in Example 6, then being raised on the surface using sand paper, to obtain a leather-like sheet. The obtained sheet was strong in rubber-like hand and did not have a compactness similar to that of natural leather. The physical properties of the obtained leather-like sheet are shown in Table 2.

Comparative Example 7

The nonwoven fabric containing ultra-fine fibers obtained in Comparative Example 1 was raised on the surface using sand paper, without being dyed, to obtain a white sheet. The physical properties of the white sheet were virtually the same as those of the nonwoven fabric containing ultra-fine fibers, but did not appear like leather, being poor also in abrasion resistance. The results are shown in Table 2.

Comparative Example 8

The nonwoven fabric containing ultra-fine fibers obtained in Comparative Example 3 was treated as described in Example 7, to obtain a sheet. The obtained sheet was not broken when dyed and was excellent in such properties as tensile strength and tear strength. However, it was fluffy on the surface, being poor in surface appearance, and did not appear like leather. It was also poor in abrasion resistance. The physical properties are shown in Table 2.

TABLE 2

| | Weight per unit area ($g/m^2$) | Apparent density ($g/cm^3$) | Tensile strength (N/cm) Length direction | Tensile strength (N/cm) Width direction | Tear strength (N) Length direction | Tear strength (N) Width direction | Martindale abrasion Loss (mg) | Martindale abrasion Number of pills |
|---|---|---|---|---|---|---|---|---|
| Example 5 | 250 | 0.340 | 143 | 130 | 19.1 | 14.1 | 3 | 3 |
| Example 6 | 242 | 0.592 | 119 | 105 | 14.1 | 11.3 | 1 | 1 |
| Example 7 | 185 | 0.501 | 106 | 75 | 15.6 | 8.1 | 4 | 0 |
| Example 8 | 480 | 0.571 | 322 | 271 | 31 | 31 | 10 | 5 |
| Example 9 | 171 | 0.546 | 112 | 91 | 20.8 | 13.3 | 0 | 1 |
| Example 10 | 244 | 0.350 | 144 | 100 | 13.0 | 10.1 | 2 | 0 |
| Comparative Example 6 | 240 | 0.210 | 70 | 62 | 8.5 | 6.0 | 1 | 1 |
| Comparative Example 7 | 195 | 0.255 | 101 | 82 | 23.0 | 22.7 | 22 | 18 |
| Comparative Example 8 | 220 | 0.275 | 105 | 94.6 | 20.6 | 23.5 | 12 | 6 |

TABLE 1

| | Weight per unit area ($g/m^2$) | Apparent density ($g/cm^3$) | Tensile strength (N/cm) Length direction | Tensile strength (N/cm) Width direction | Tear strength (N) Length direction | Tear strength (N) Width direction | 10% modulus (N/cm) Length direction | 10% modulus (N/cm) Width direction |
|---|---|---|---|---|---|---|---|---|
| Example 1 | 210 | 0.334 | 131 | 102 | 8.6 | 6.0 | 14.6 | 6.1 |
| Example 2 | 212 | 0.337 | 132 | 109 | 9.4 | 6.5 | 15 | 5.5 |
| Example 3 | 300 | 0.370 | 133 | 122 | 19.3 | 14.6 | 14.4 | 8.4 |
| Example 4 | 199 | 0.343 | 123 | 100 | 13.2 | 6.5 | 10.3 | 4.6 |
| Comparative Example 1 | 198 | 0.274 | 109 | 99 | 22.8 | 23.4 | 6 | 3 |
| Comparative Example 2 | 191 | 0.265 | 105 | 90 | 23.1 | 22.6 | 5.5 | 3 |
| Comparative Example 3 | 255 | 0.275 | 143 | 117 | 13.7 | 12.7 | 7.1 | 5.4 |

INDUSTRIAL APPLICABILITY

According to this disclosure, a nonwoven fabric that does not substantially contain any elastomer and is mainly made of a fiber material can be used as a leather-like sheet having sufficient physical properties and quality. Since the leather-like sheet has excellent features such as recyclability, easy care property and yellowing resistance, it can of course be used in such applications as clothing, furniture, car seat, miscellaneous goods, abrasive cloth, wiper and filter, and among the applications, it can be especially preferably used as a car seat, or clothing because of its recyclability and characteristic hand. Furthermore, a suede-like leather-like sheet is excellent in surface fiber denseness, fiber opening capability and uniformity, since the ultra-fine fibers are unlikely to be bundled. So, abrasive cloth for polishing magnetic recording medium base materials such as recording discs is one of preferable useful applications of it.

The invention claimed is:

1. A nonwoven fabric, containing ultra-fine fibers and does not contain an elastomer, which contains staple fibers with a fiber fineness of 0.0001 to 0.5 decitex and a fiber length of 2 cm to 10 cm and at least substantially all of the ultra-fine fibers are uniformly entangled with each other such that there is substantially no entanglement between bundles of ultra-fine fibers in the thickness direction, and has a weight per unit area of 100 to 550 $g/m^2$, an apparent density of 0.280 to 0.700 $g/cm^3$, a tensile strength of 70 N/cm or more, a 10% modulus in the length direction is 8 N/cm or more and a tear strength of 3 to 50 N.

2. The nonwoven fabric according to claim 1, wherein said staple fibers are polyester-based fibers and/or polyamide-based fibers.

3. A method for producing a nonwoven fabric containing ultra-fine fibers as set forth in claim 1, comprising:

needle-punching islands-in-sea type composite fibers of 1 to 10 decitex convertible into bundles of ultra-fine fibers of 0.0001 to 0.5 decitex at a punching density of 500 needles/$cm^2$ or more, to produce a nonwoven fabric containing composite fibers, removing the sea component of the composite fibers to produce the ultra-fine fibers and performing hydro-entanglement of the ultra-fine fibers such that there is substantially no entanglement between bundles of ultra-fine fibers at a pressure of at least 10 MPa after forming at least substantially all of the ultra-fine fibers to produce a nonwoven fabric which does not contain an elastomer.

4. The method according to claim 3, wherein the nonwoven fabric containing composite fibers produced by said needle punching has an apparent density of 0.120 to 0.300 g/$cm^3$.

5. The method according to claim 3, wherein a nozzle having holes with a diameter of 0.06 to 0.15 mm is used to perform said hydro-entanglement.

6. The method according to claim 3, wherein a treatment for forming ultra-fine fibers is performed after performing said needle punching of the composite fibers, and before performing said hydro-entanglement and/or simultaneously with said hydro-entanglement.

7. The method according to claim 3, wherein splitting into two or more sheets perpendicularly to the thickness direction is performed before performing said hydro-entanglement.

8. The method according to claim 3, wherein pressing to 0.1. to 0.8 times in thickness is performed after performing said hydro-entanglement.

9. An artificial leather sheet which contains a dyed nonwoven fabric containing ultra-fine fibers with a fiber fineness of 0.0001 to 0.5 decitex, a fiber length of 2 cm to 10 cm, and at least substantially all of the ultra-fine fibers are uniformly entangled with each other such that there is substantially no entanglement between bundles of ultra-fine fibers in the thickness direction, a weight per unit area of 100 to 550 g/$m^2$ and an apparent density of 0.230 to 0.700 g/$cm^3$, a tensile strength of 70 N/cm or more, and has a tear strength of 3 to 50 N and satisfies the following formula:

Tensile strength (N/cm)$\geqq$0.45×Weight per unit area (g/$m^2$)−40; and which does not contain an elastomer.

10. The artificial leather sheet according to claim 9, wherein the ultra-fine fibers are made of a non-elastic polymer.

11. The artificial leather sheet according to claim 9, wherein it is raised by sand paper or brush at least on one surface.

12. The artificial leather sheet according to claim 9, wherein, in an abrasion test by the Martindale method, the abrasion loss after 20000 times of abrasion is 20 mg or less and the number of pills is 5 or less.

13. The artificial leather according to claim 9, wherein said ultra-fine fibers are made of a polyester and/or a polyamide.

14. The artificial leather according to claim 9, containing fine particles.

15. The artificial leather according to claim 14, wherein the particle diameter of said fine particles is from 0.001 to 30 μm.

* * * * *

UNITED STATES PATENT AND TRADEMARK OFFICE

CERTIFICATE OF CORRECTION

PATENT NO. : 7,998,887 B2
APPLICATION NO. : 10/564789
DATED : August 16, 2011
INVENTOR(S) : Horiguchi et al.

It is certified that error appears in the above-identified patent and that said Letters Patent is hereby corrected as shown below:

In Column 1

At line 9, please change "§71" to --§371--.

In Column 3

At line 10, please change "1.0 cm" to --10 cm--; and at line 26, please change "0:5" to --0.5--.

Signed and Sealed this
Twentieth Day of December, 2011

David J. Kappos

David J. Kappos
*Director of the United States Patent and Trademark Office*